US007384034B2

(12) United States Patent
Nagura et al.

(10) Patent No.: US 7,384,034 B2
(45) Date of Patent: Jun. 10, 2008

(54) SHEET CONVEY APPARATUS

(75) Inventors: Yasukazu Nagura, Shizuoka (JP); Toru Uchida, Shizuoka (JP)

(73) Assignee: NEC Corporation, Tokyo (JP)

( * ) Notice: Subject to any disclaimer, the term of this patent is extended or adjusted under 35 U.S.C. 154(b) by 296 days.

(21) Appl. No.: 11/008,281

(22) Filed: Dec. 10, 2004

(65) Prior Publication Data

US 2005/0189701 A1 Sep. 1, 2005

(30) Foreign Application Priority Data

Dec. 12, 2003 (JP) ..... 2003-415628

(51) Int. Cl.
*B65H 3/52* (2006.01)

(52) U.S. Cl. ..... 271/125; 271/122; 271/121; 271/167

(58) Field of Classification Search ..... 271/122, 271/274, 125, 124, 121, 167
See application file for complete search history.

(56) References Cited

U.S. PATENT DOCUMENTS

| | | | | |
|---|---|---|---|---|
| 5,738,452 | A * | 4/1998 | Uchida | 400/624 |
| 5,887,866 | A * | 3/1999 | Yamauchi et al. | 271/116 |
| 6,050,563 | A * | 4/2000 | Vedoy et al. | 271/10.07 |
| 2002/0020959 | A1 * | 2/2002 | Matsuda et al. | 271/122 |

FOREIGN PATENT DOCUMENTS

| | | | |
|---|---|---|---|
| JP | H09-235036 | A | 9/1997 |
| JP | 11-227971 | A | 8/1999 |
| JP | 2000-159370 | A | 6/2000 |

* cited by examiner

*Primary Examiner*—Kaitlin S. Joerger
(74) *Attorney, Agent, or Firm*—Sughrue Mion, PLLC

(57) ABSTRACT

A sheet convey apparatus includes a main feed roller, retard roller, torque limiter, retard roller guide, a pair of bearings, and a spring. The main feed roller rotates in a predetermined direction in contact with one surface of a paper sheet, to give to the sheet a force to convey the sheet in a sheet convey direction. The retard roller is arranged to oppose the main feed roller and gives to the sheet with which the retard roller is in contact a force to convey the sheet in a direction opposite to the sheet convey direction. The torque limiter limits a torque of the retard roller and rotates the retard roller in the sheet convey direction when the torque exceeds a predetermined limit. The retard roller guide includes at least a surface inclined with respect to a plane connecting central axes of the main feed roller and retard roller at an angle in a range of 0° (exclusive) to 90° (inclusive). The inclined surface is located in the vicinity of the central axis of the retard roller. The pair of bearings rotatably support a rotating shaft of the retard roller. The spring urges a bearing of the retard roller against the inclined surface of the retard roller guide to generate a component toward the main feed roller which is perpendicular to a reaction force from the inclined surface.

15 Claims, 7 Drawing Sheets

SHEET CONVEY APPARATUS

BACKGROUND OF THE INVENTION

The present invention relates to a sheet convey apparatus for conveying sheets one by one in the apparatus as in a copying machine, facsimile apparatus, or a certain type of scanner and, more particularly, to a sheet convey apparatus having a mechanism for preventing overlapping feed of a paper sheet.

In general, in an apparatus such as a document reading apparatus which reads a document, a printer or copying machine which prints an image, or the like, a plurality of sheet-type documents or a plurality of recording sheets are set on a tray. Image reading or printing is performed on the sheets one by one. In a sheet convey apparatus in which a paper sheet is conveyed in this manner, the plurality of sheets set on the tray must be separated one by one reliably and be fed into the apparatus. If overlapping sheets are fed, some document may be left unread, or an inconvenience may occur during conveyance, and printing is not performed well. For this reason, an overlapping feed preventive device is attached to the sheet convey apparatus.

As the overlapping feed preventive device, a comparatively large one is available which includes a mechanism to chuck the stacked sheets one by one from the uppermost layer and feed them into the apparatus. Generally, a device is used which feeds the uppermost sheet by considering the rotating directions of a pair of feed rollers.

As shown in FIG. 8, a conventional sheet convey apparatus 300 has a main feed roller 303 which applies a conveying force in a convey direction 302 to stacked sheets 301, and a retard roller (or separation roller) 304 which applies a conveying force in a direction opposite to the convey direction 302. When the sheets 301 including two stacked sheets as shown in FIG. 8 enter between the main feed roller 303 and retard roller 304, the main feed roller 303 applies a frictional force in the convey direction 302 to a first uppermost sheet 3011, and the retard roller 304 applies a frictional force in a direction opposite to the convey direction 302 to a second uppermost sheet $\mathbf{301}_2$. If the frictional force between the sheets $\mathbf{301}_1$ and $\mathbf{301}_2$ is sufficiently smaller than the frictional force between the two rollers 303 and 304, the first uppermost sheet 301, is conveyed in the convey direction 302. Simultaneously, the second uppermost sheet $\mathbf{301}_2$ receives from the retard roller 304 a force to push it back in the direction opposite to the convey direction 302. Consequently, only the first uppermost sheet $\mathbf{301}_1$ is fed into the apparatus, and overlapping feed is prevented.

Assume a case wherein the frictional force of the retard roller 304 with respect to the sheet 301 is larger than that of the main feed roller 303. This is based on the premise that the frictional coefficients of the two surfaces of the sheet 301 are equal. On this premise, when only one sheet 301 enters between the main feed roller 303 and retard roller 304, the convey force in the direction opposite to the convey direction 302 which is caused by the friction of the retard roller 304 becomes larger than the convey force in the convey direction 302 which is caused by the friction of the main feed roller 303. Therefore, in this case, the sheet 301 cannot be conveyed in the convey direction 302.

In order to solve this problem, it has been proposed to attach a torque limiter to a retard roller, as shown in Japanese Patent Laid-Open No. 9-235036, to limit the driving force of the retard roller.

When the torque limiter is attached to the retard roller, the press by the main feed roller 303 and retard roller 304 and the torque of the torque limiter must satisfy both the first and second conditions to be described hereinafter. This will be explained with reference to FIG. 8.

The first condition applies when one sheet 301 is present between the main feed roller 303 and retard roller 304. According to the first condition, the retard roller 304 must rotate in a direction (counterclockwise) to convey the sheet 301 in the convey direction 302, so that the sheet 301 is conveyed in the convey direction 302 stably. More specifically, while a force to rotate the retard roller 304 in the direction (clockwise) indicated by an arrow is transmitted to the retard roller 304, the retard roller 304 must be rotated by the main feed roller 303 in a direction opposite to the transmitted force.

The second condition applies when two or more sheets 301 are present between the main feed roller 303 and retard roller 304. According to the second condition, the retard roller 304 must rotate in the direction (clockwise) indicated by the arrow so as to push back all the sheets $\mathbf{301}_2$ except for the first uppermost sheet 301, which is in contact with the main feed roller 303.

When a torque limiter is to be attached to the retard roller 304, its torque must satisfy the first and second conditions. If the torque of the torque limiter is excessively large or the pressing force between the main feed roller 303 and retard roller 304 is small, the first condition cannot be satisfied. If the torque of the torque limiter is excessively small or the pressing force between the main feed roller 303 and retard roller 304 is large, the second condition cannot be satisfied.

The torque of the torque limiter does not always maintain a constant value, but changes to a certain degree. On the sheet convey apparatus side, the degree of wear of the retard roller 304 and the state of the sheets 301 change. Consequently, while the sheet convey apparatus functions well at a certain time with respect to the sheets 301 in various types of states, overlapping feed may occur at another time, or one sheet 301 cannot be conveyed well.

SUMMARY OF THE INVENTION

It is an object of the present invention to provide a sheet convey apparatus which can reliably convey sheets stably even if the torque of a torque limiter on a retard roller side changes a little.

In order to achieve the above object, according to the present invention, there is provided a sheet convey apparatus comprising a main feed roller which rotates in a predetermined direction in contact with one surface of a paper sheet, to give to the sheet a force to convey the sheet in a sheet convey direction, a retard roller which is arranged to oppose the main feed roller and gives to the sheet with which the retard roller is in contact a force to convey the sheet in a direction opposite to the sheet convey direction, a torque limiter which limits a torque of the retard roller and rotates the retard roller in the sheet convey direction when the torque exceeds a predetermined limit, a guide member which includes at least a surface inclined with respect to a plane connecting central axes of the main feed roller and retard roller at an angle in a range of 0° (exclusive) to 90° (inclusive), the inclined surface being located in the vicinity of the central axis of the retard roller, a pair of bearings which rotatably support a rotating shaft of the retard roller, and press application means for urging a bearing of the retard roller against the inclined surface of the guide member to generate a component toward the main feed roller which is perpendicular to a reaction force from the inclined surface.

DESCRIPTION OF THE PREFERRED EMBODIMENT

Figure 1:
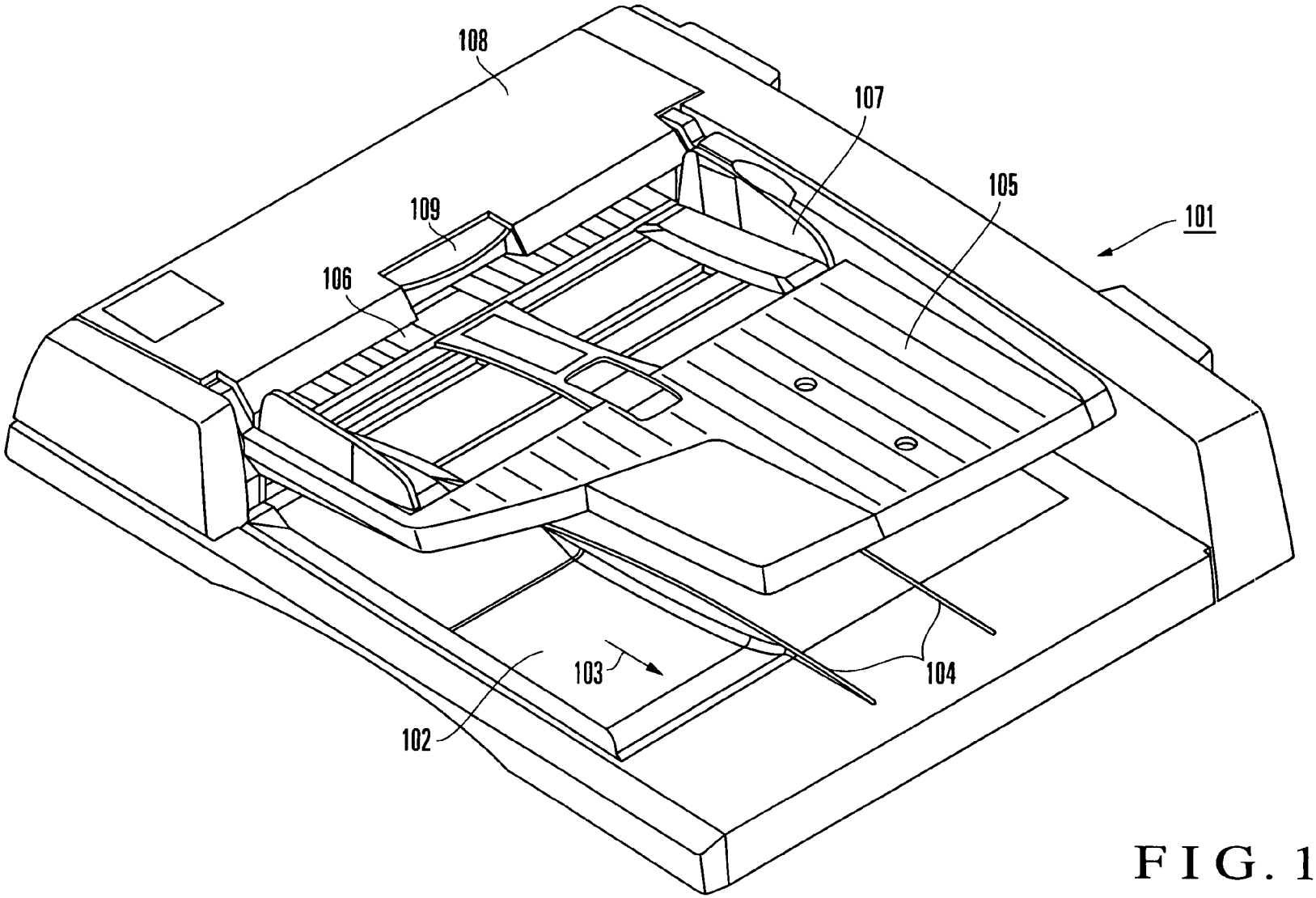
FIG. 1 is a main part perspective view showing the appearance of a document convey apparatus according to an embodiment of the present invention.

A document convey apparatus according to an embodiment of the present invention will be described with reference to FIGS. 1 to 7. Referring to FIG. 1, a document convey apparatus 101 forms the top portion of a document reading apparatus. An apparatus main body portion which is arranged under the document reading apparatus and includes a scanner module formed of an optical system or the like to read a document, an image processing circuit, or a power supply circuit is not shown.

The document convey apparatus 101 has a stacker 102 which extends horizontally so as to be placed on the document reading apparatus main body described above. A document that has been read is stacked on the stacker 102. Two rod-like projections 104 project from the bottom surface of the stacker 102 in a document discharge direction indicated by an arrow 103. A document tray 105 is arranged above the stacker 102 at a predetermined gap. A reading target document is set on the document tray 105 such that the leading edge of the document is inserted in a document insertion port 106. Document guides 107 movable in the widthwise direction of the document are attached before the document insertion port 106 of the document tray 105.

An openable upper unit 108 is arranged on the upper deep side on the document insertion port 106. When a handle 109 located above the center of the document insertion port 106 is lifted upward, the upper unit 108 pivots about the fulcrum as the center, to open the internal space near the inlet of the document insertion port 106. Then, paper jamming (jam) in the apparatus can be removed.

Figure 2:
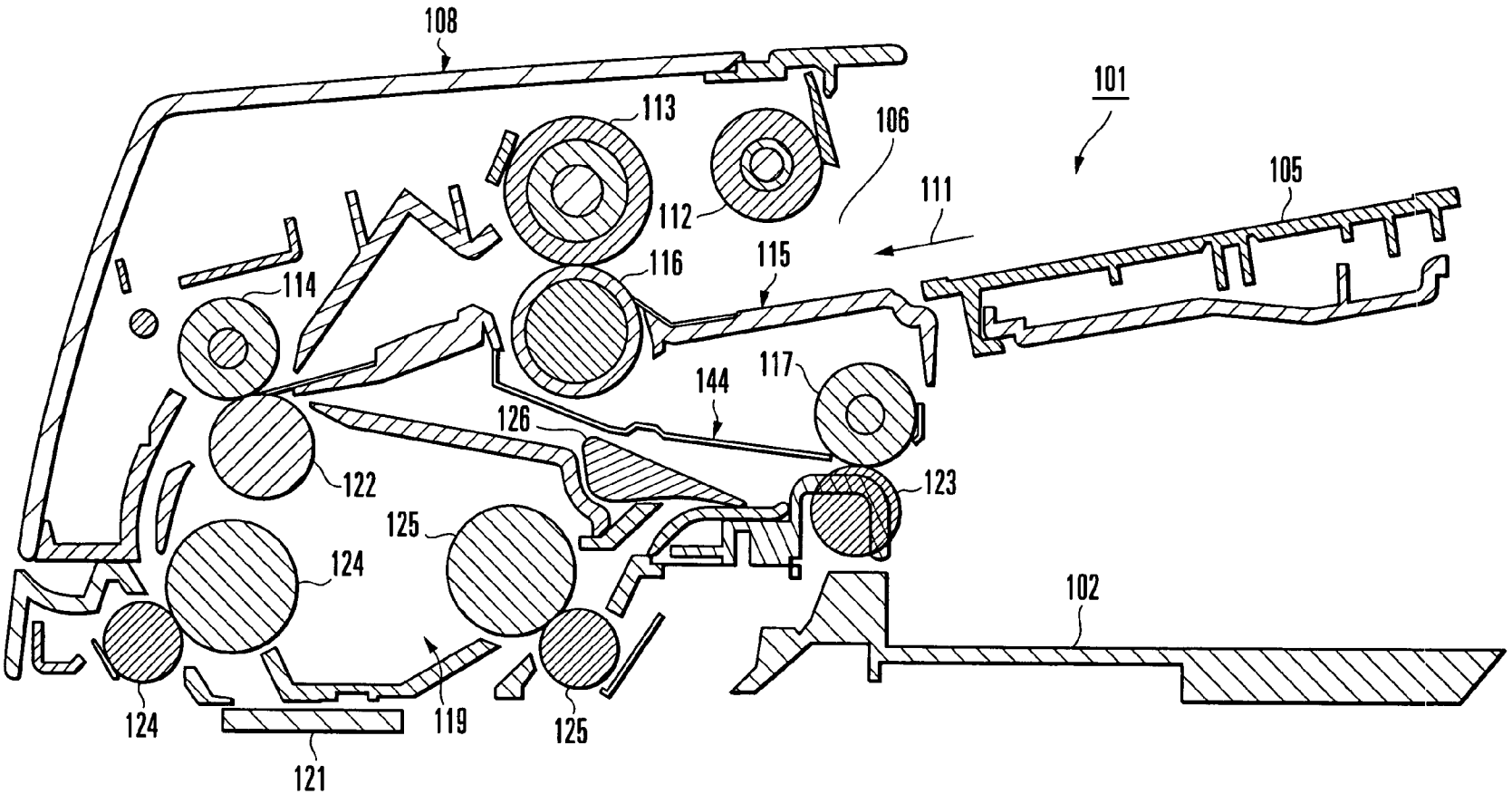
FIG. 2 is an end face view showing the internal structure of the document convey apparatus shown in FIG. 1.

As shown in FIG. 2, the document convey apparatus 101 has three units, i.e., the upper unit 108 and units 115 and 119 that form a document convey space. The upper unit 108 shown in FIG. 1 is arranged at the uppermost portion of the document convey apparatus 101. In the upper unit 108, a total of three rollers, i.e., a guide roll 112 which guides the leading edge of the document to be inserted, a main feed roller 113 which feeds the document inward, and a convey roller 114 are arranged sequentially from the document insertion port 106 on the upper surface side of the document which is to be fed in a direction of an arrow 111 along the document tray 105.

The middle unit 115 is arranged immediately under the upper unit 108. The middle unit 115 also has a mechanism that pivots about a fulcrum as the center, as will be described later. The middle unit 115 has a retard roller 116 in rolling contact with the main feed roller 113 of the upper unit 108, and discharge rollers 117 which discharge the document to the stacker 102 and feed the document into the apparatus again when the two sides of the document are to be read. The discharge rollers 117 are driving rollers driven by a driving source (not shown).

The lower unit 119 is arranged further below the middle unit 115. A glass platen 121 is arranged in an opening formed in the bottom of the lower unit 119. An optical system and reading element (not shown) are arranged at the apparatus main body portion under the glass platen 121, and read the image information of the document passing on the glass platen 121. The lower unit 119 has a convey roller 122 in rolling contact with the convey roller 114 of the upper unit 108, a discharge roller 123 in rolling contact with the discharge rollers 117, and two convey roller pairs, i.e., a pair of convey rollers 124 and pair of convey rollers 125. A flapper 126 which has a wedge-shaped section and switches the document convey direction is arranged at a position before the discharge rollers 117 in the lower unit 119.

A document convey state in the document convey apparatus 101 having the above structure will be described briefly.

An operation of reading only one side of a document will be described. When the document is set on the document tray 105, the guide roll 112 moves downward while rotating, to come into contact with the uppermost layer of the document. Thus, the set document is fed out toward the nip region of the main feed roller 113 and retard roller 116. The document, the leading edge of which is introduced to the nip region, is fed into the apparatus one by one by the main feed roller 113 and retard roller 116. The retard roller 116 rotates in a direction opposite to the rotating direction of the main feed roller 113, to prevent overlapping feed during feeding.

The document passing between the main feed roller 113 and retard roller 116 passes between the pair of convey rollers 114 and 122, then between the pair of convey rollers 124, and is conveyed on the glass platen 121. At this time, the image information on the first surface of the document is read by using a reading element (not shown). After the reading, the document passes between the pair of convey rollers 125, pushes up the distal end of the valve-like flapper 126 from below, passes between the pair of discharge rollers 117 and the discharge roller 123, and is discharged onto the stacker 102. In this manner, the document set on the document tray 105 is fed into the document convey apparatus 101 one by one, and image information on one side (the upper surface of the document set on the document tray 105) of each document is read sequentially.

A case wherein the two sides of the document are to be read will be described. In this case, of the document fed from the document tray 105 into the document convey apparatus 101, the image information on the first surface is read in the manner as described above. As the reading proceeds, the document is fed to the stacker 102 by the pair of discharge rollers 117 and the discharge roller 123 from the leading edge of the document. At this time, the first surface of the document sheet that has been read is located on the lower side.

When the trailing edge of the document sheet reaches the nip region of the pair of discharge rollers 117 and the discharge roller 123, at this timing, the pair of discharge rollers 117 and the discharge roller 123 start to rotate in opposite directions. Thus, the trailing edge of the document sheet passes on the upper surface of the flapper 126, moves forward substantially horizontally through the boundary portion of the middle unit 115 and lower unit 119, and passes between the pair of convey rollers 114 and 122. Consecutively, the document passes between the pair of convey rollers 124 again and is conveyed on the glass platen 121. At this time, the reading element (not shown) reads the image information on the second surface of the document. The document that has been read passes between the pair of convey rollers 125, pushes up the distal end of the valve-like flapper 126 from below, passes between the pair of discharge rollers 117 and the discharge roller 123, and is discharged onto the stacker 102. In this manner, the image information on the two sides of the document sheet are read.

Figure 3:
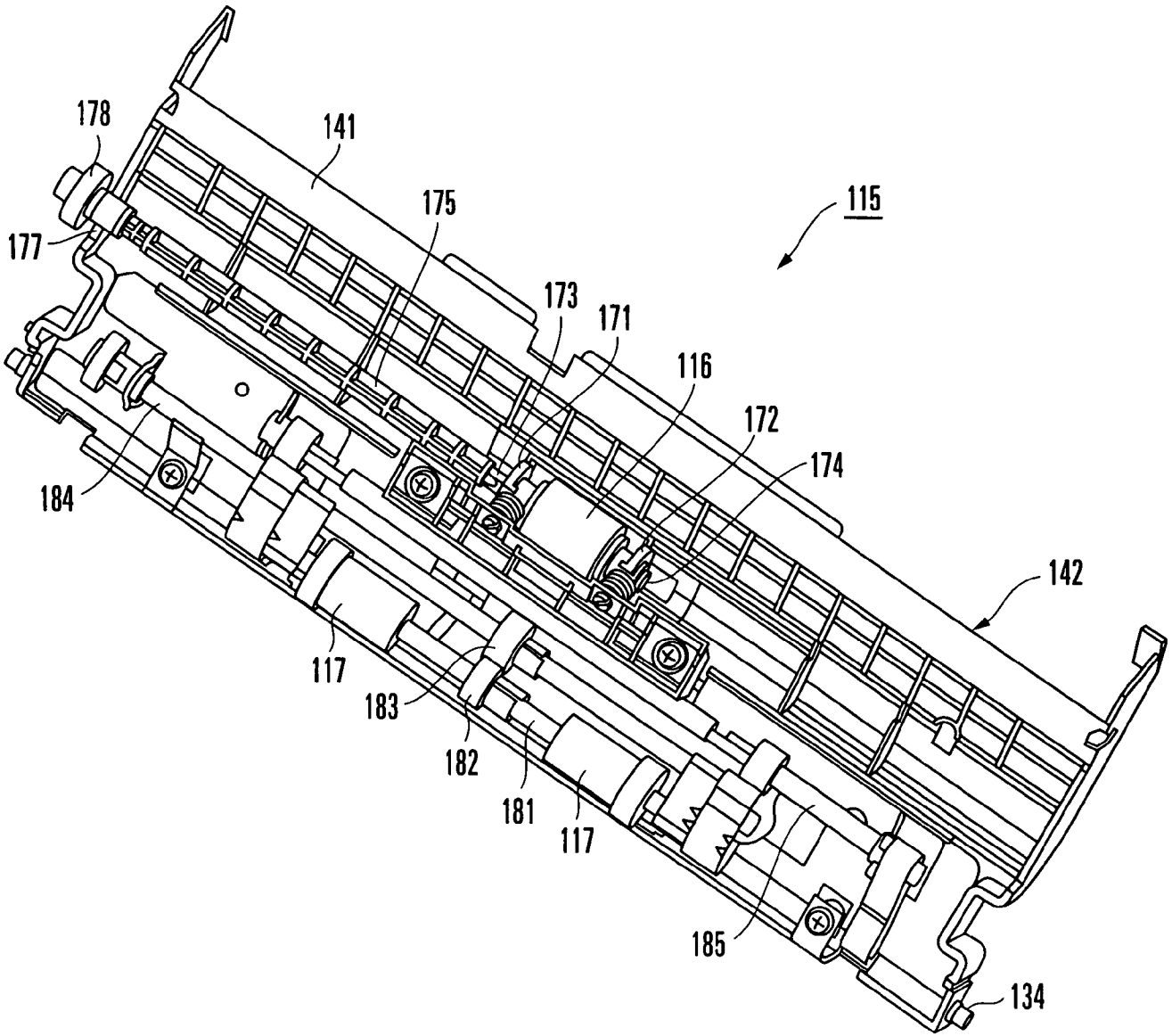
FIG. 3 is a perspective view obtained when the top unit of the middle unit shown in FIG. 2 is looked up from below.

As shown in FIG. 3, the middle unit 115 includes a top unit 142, and a bottom unit 144 (FIG. 2) mainly constituted by a return guide which extends between the retard roller 116 and discharge rollers 117 serves as a guide member. A pair of retard roller guides 171 and 172 each having an inverted-U shape are attached to substantially the center of the lower surface of a feed guide 141 which forms the top unit 142, such that the retard roller guides 171 and 172 project from their periphery at a predetermined gap from each other. Rotating shafts 173 an 174 of the retard roller 116 are urged against the inner surfaces of the retard roller guides 171 and 172 by the pressing forces of two springs (not shown) through bearings (not shown).

One end of a driving shaft 175 is attached to one rotating shaft 173. The driving shaft 175 transmits a driving force to the rotating shaft 173. The driving shaft 175 is pivotally supported by a bearing portion 177 projecting from the lower surface of the end portion of the feed guide 141. A rotation force of the driving force (not shown) is transmitted to the driving shaft 175 from a rotation force transmission mechanism 178 such as a gear arranged on the projecting end portion side to the driving shaft 175. The rotating shafts 173 and 174 of the retard roller 116 are supported by the two springs (described above) independently of each other. The position and inclination of the center axis of the retard roller 116 change in accordance with a change in thickness or the like of the document sheet inserted between the retard roller 116 and main feed roller 113 (FIG. 2). However, of the driving shaft 175, the distance from the bearing portion 177 to the rotating shaft 173 is much longer than the distance from the bearing portion 177 to the rotation force transmission mechanism 178. Therefore, even when the position and inclination of the retard roller 116 change, the change will not substantially adversely affect the rotation force transmission mechanism 178, and the driving force can be transmitted smoothly.

The pair of discharge rollers 117, to which a driving force from one driving shaft 181 is transmitted, are attached to that side of the top unit 142 where rotating shafts 134 are attached. The driving shaft 181 receives a driving force transmitted from another driving shaft 184 through rotation force transmission mechanisms 182 and 183 such as gears. In the top unit 142, a transmission shaft 185 is arranged, at almost the middle position of the driving shaft 184 and retard roller 116, to be parallel to the driving shaft 184. The transmission shaft 185 transmits a torque load that separates the discharge rollers 117 and 123 from each other.

Figure 4:
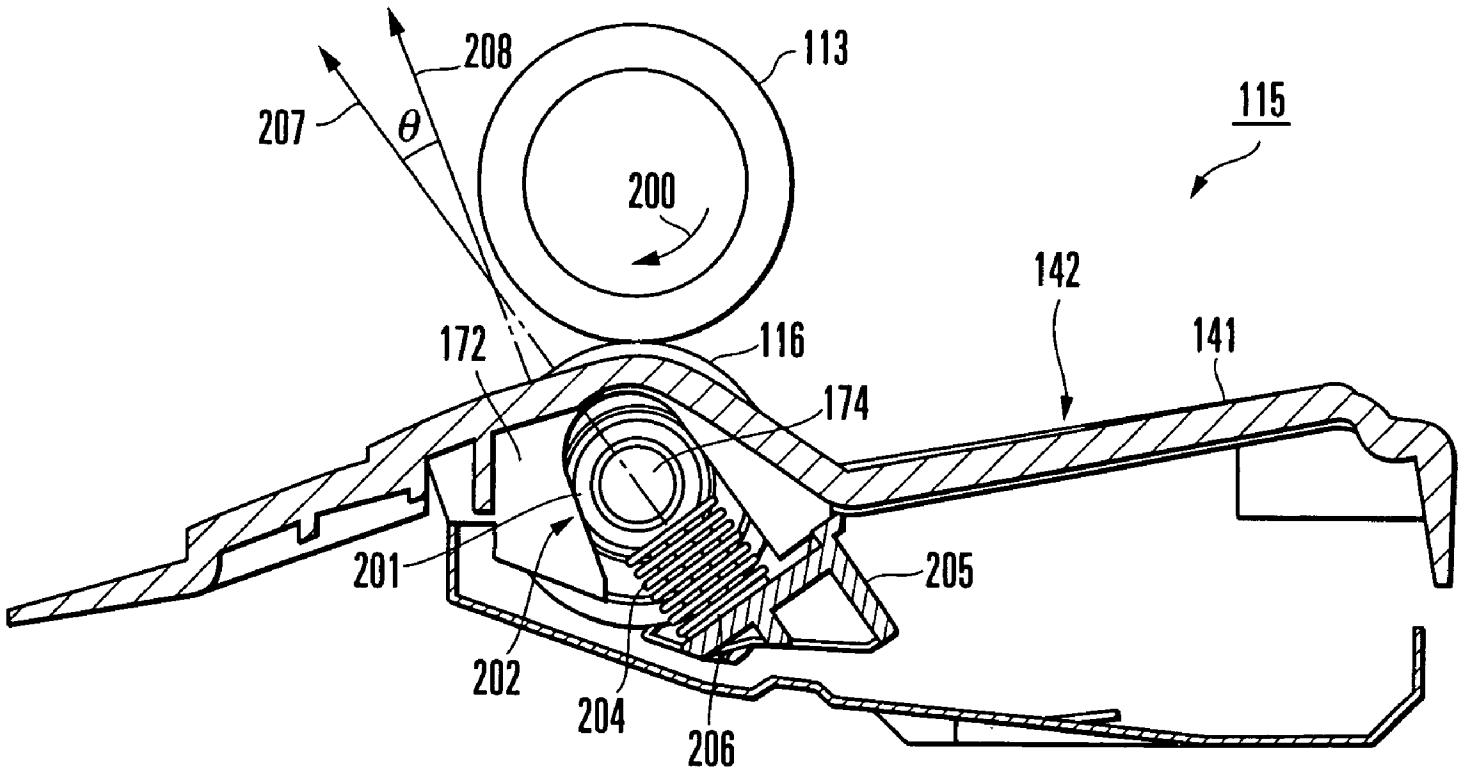
FIG. 4 is a sectional view of the middle unit shown in FIG. 3 taken along a direction perpendicular to the center axis of a retard roller.

FIG. 4 shows the section of the middle unit 115 taken at the right side of the retard guide roller 172 in FIG. 3 along a direction perpendicular to the rotating shaft. The retard roller guide 172 having an inverted-U-shaped notched surface (section) is attached to the middle unit 115. A bearing 201 is attached to the rotating shaft 174 of the retard roller 116 in rolling contact with the main feed roller 113 which rotates in a direction of an arrow 200 to feed a sheet into the apparatus. The bearing 201 is made of a low-friction material such as a polyacetal resin. The outer surface of the bearing 201 comes into slidable contact with an inner surface 202 of the retard roller guide 172. A projecting piece (not shown) is formed on the bearing 201. A spring 204 is attached to the bearing 201 such that one end of the spring 204 is fitted with the projecting piece of the bearing 201.

The other end of the spring 204 is attached to one end portion 206 of a return guide 205 attached to the lower surface of the feed guide 141 which forms the top unit 142. The spring 204 serves to urge the bearing 201 in a direction of an arrow 207 against the inner surface 202 of the retard roller guide 172. The inner surface 202 of the retard roller guide 172, with which the bearing 201 comes into contact, forms a linear notched end face. The direction of an arrow 208 on the extension line of the inner surface 202 is inclined at an angle θ clockwise from the direction of the arrow 207.

Figure 5:
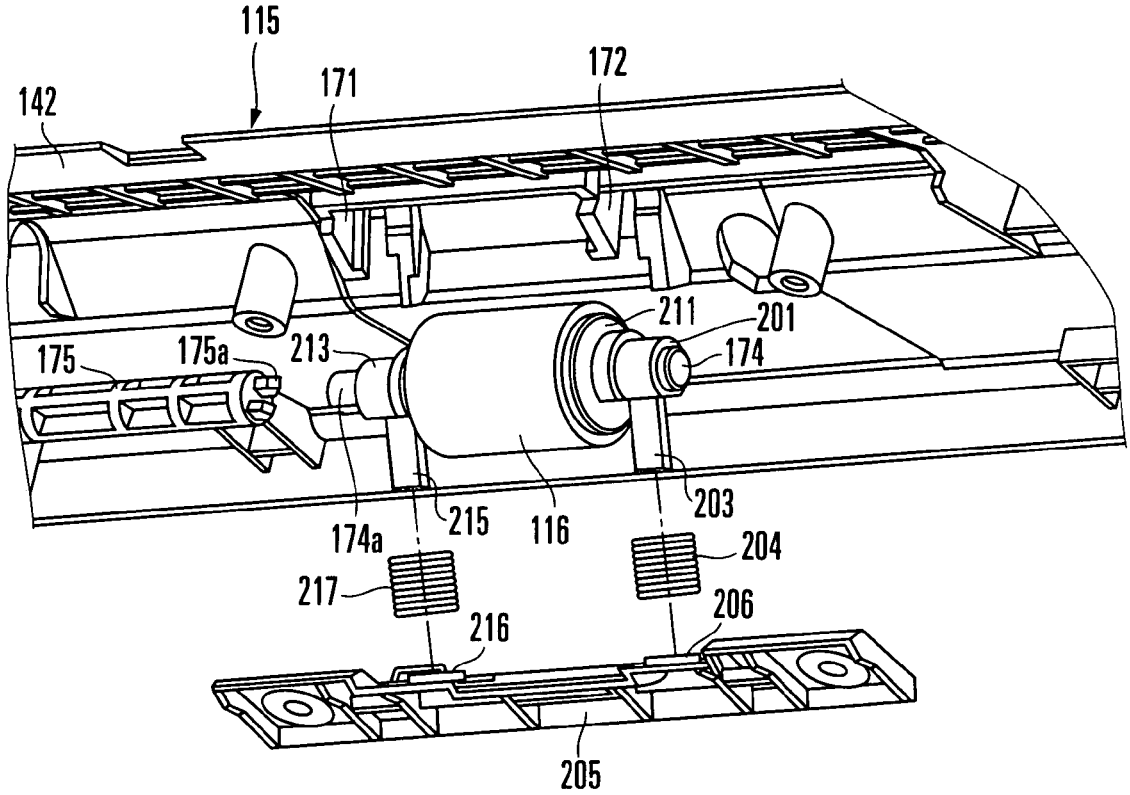
FIG. 5 is a main part perspective view showing a state before the retard roller is incorporated in the top unit which constitutes the middle unit shown in FIG. 3.
Figure 6:
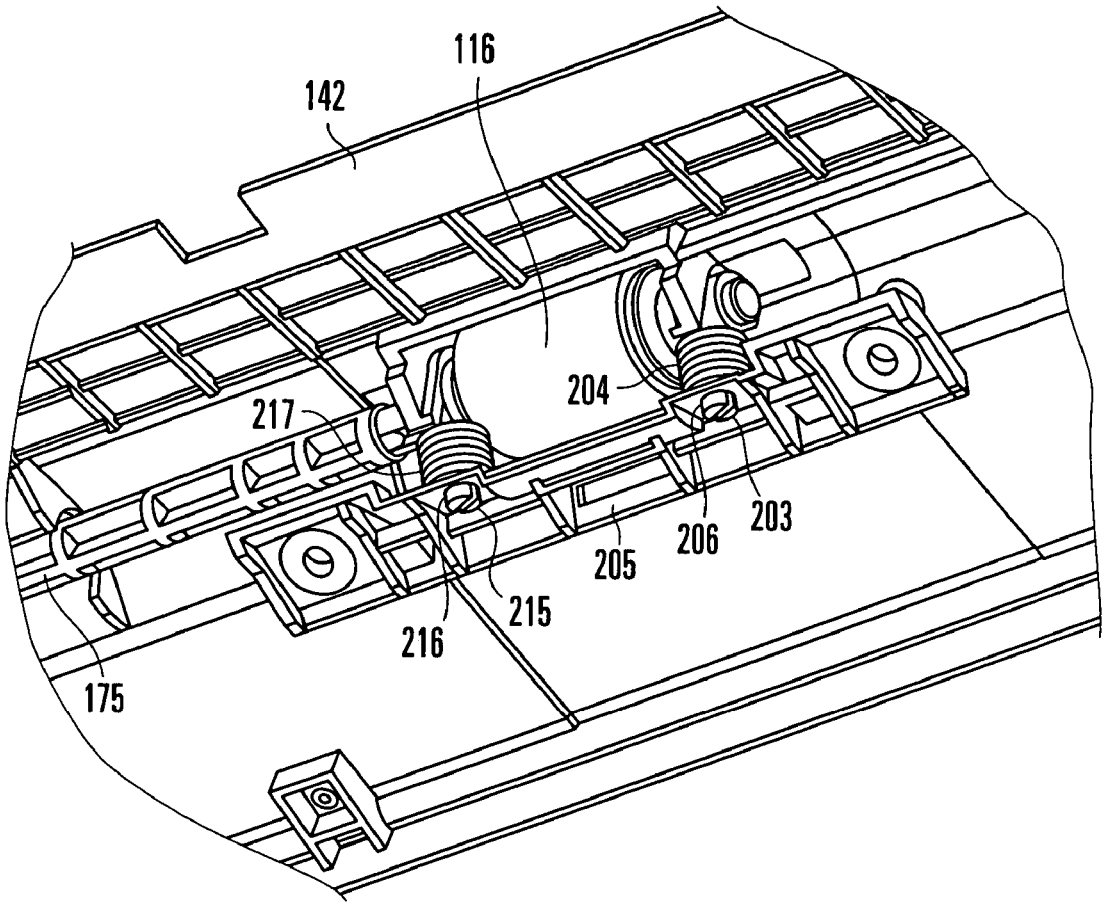
FIG. 6 is a perspective view showing a state of the main part wherein the retard roller is incorporated in the top unit which constitutes the middle unit shown in FIG. 3.

Referring to FIG. 5, the pair of retard roller guides 171 and 172 are attached to the top unit 142 which forms the middle unit 115. A torque limiter 211 is mounted in the retard roller 116. The bearing 201 is attached to the rotating shaft 174 projecting from one end face of the retard roller 116. A bearing 213 is attached to the other end face of the retard roller 116. A joint 174*a* which forms the end portion of a rotating shaft held by the bearing 213 is connected to a joint 175*a* which forms one end of the driving shaft 175. Thus, a driving force is transmitted to the retard roller 116.

The bearing 213 has a projecting piece 215 similar to a projecting piece 203 of the bearing 201. The spring 204 is attached between the projecting piece 203 and one end 206 of the return guide 205, and a spring 217 is attached between the projecting piece 215 and another one end 216 of the return guide 205. In this structure, the springs 204 and 217 act on the pair of bearings 201 and 213 respectively and independently, to press the corresponding portions of the retard roller guides 171 and 172. This generates a force that brings the retard roller 116 into tight contact with the main feed roller 113 (FIG. 4).

The inner surfaces of the retard roller guides 171 and 172 form U-shaped notched surfaces (sections), and accordingly curved surface regions other than the linear inclined surfaces (described above) are present. This is based on the following consideration. When the upper unit 108 is opened, the tight contact state of the main feed roller 113 with the retard roller 116 is canceled, and sometimes the retard roller 116 is moved upward by the springs 204 and 217.

Figure 7:
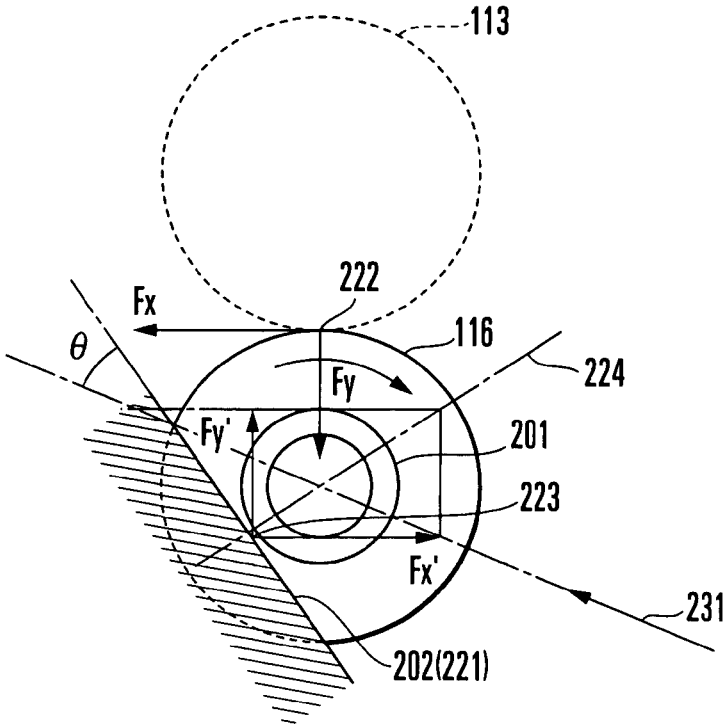
FIG. 7 is a view for explaining forces around the retard roller which are generated by the torque of a torque limiter.
Figure 8:
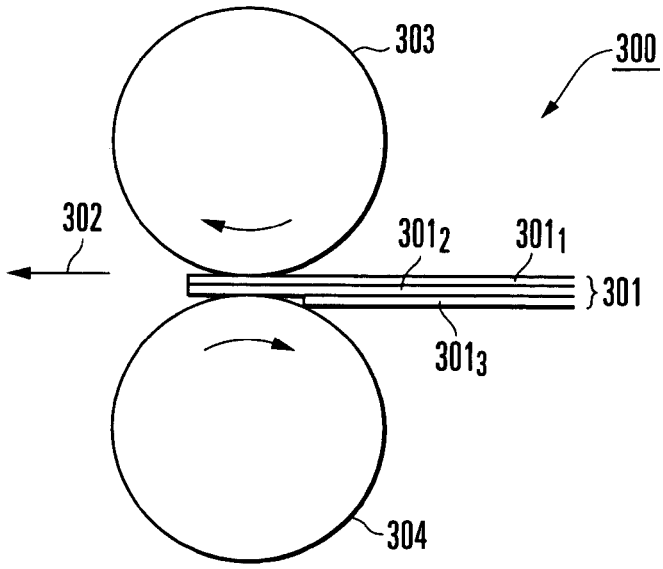
FIG. 8 PRIOR ART
FIG. 8 is a view for explaining the main part of a conventional sheet convey apparatus.

As shown in FIG. 7, the bearing 201 of the retard roller 116 comes into contact with an inclined surface portion 221 of the inner surface 202 of the retard roller guide 172. The retard roller 116 receives a rotation force (moment) M from the torque of the torque limiter 211 and the driving force. At a rolling contact portion 222 of the retard roller 116 and main feed roller 113, this moment generates a force F expressed by the following equation (1):

$$F=M/R \quad (1)$$

where R is the radius of the retard roller 116.

Consequently, as a reaction, the retard roller 116 receives a force Fx horizontally from the main feed roller 113. Upon reception of the horizontal force Fx, the retard roller 116 receives a horizontal force with a sum Fx' at a contact point 223 on the inclined surface portion 221 with which the bearing 201 is in contact. The reaction force at the inclined surface portion 221 is generated perpendicularly to the inclined surface. Therefore, an upward vertical force Fy' is generated to correspond to the horizontal force Fx'. Upon reception of the upward vertical force Fy', the retard roller 116 receives a downward force Fy from the main feed roller 113. In other words, the torque of the torque limiter 211 generates press against the retard roller 116.

When the torque of the torque limiter 211 becomes larger than that originally intended, the press against the retard roller 116 increases. Conversely, when the torque of the torque limiter 211 becomes smaller than that originally intended, the press decreases. Consequently, according to this embodiment, a change in torque of the torque limiter 211 does not much influence the press. This effect results from the fact that the force of the spring acts on the inclined surface portion 221 in FIG. 7 in a direction of an arrow 231, that is, the upward vertical force Fy' is generated at the inclined surface portion 221.

Assuming that the inclination of the inclined surface portion 221 is opposite to what is described above, a downward vertical force Fy' is generated, and the larger the torque of the torque limiter 211, the smaller the press on the retard roller 116. Consequently, only a very unstable operation can be obtained. In FIG. 7, an angle θ formed by the inclination of the inclined surface portion 221 and the direction of the force of the spring indicated by the arrow 231 is in a range of 0° (exclusive) to 90° (inclusive). Desirably, the angle θ is set between 15° to 45°.

The above description explains the relationship between the retard roller guide 172 and retard roller 116. The same applies to the relationship between the other retard roller guide 171 and the retard roller 116, and accordingly a description on this relationship is omitted.

In the embodiment described above, the retard roller 116 is connected to the driving shaft 175 through the joints 174*a* and 175*a*, and is held onto the retard roller guides 171 and 172 by the pressing forces of the springs 204 and 217. Therefore, for example, the return guide 205 can be fixed to the feed guide 141 with screws. The retard roller 116 can be removed easily by removing the screws. This is convenient when exchanging a worn-out retard roller 116 for a new one.

First Modification

In the above embodiment, the bearings 201 and 213 of the retard roller 116 are pressed by the springs 204 and 217 against the linear inclined surface portions 221 of the U-shaped notched surfaces (sections) of the retard roller guides 171 and 172. However, the present invention is not limited to this. For example, thin, elongated arm members may be arranged obliquely, and the bearings 201 and 213 of the retard roller 116 may be brought into contact with predetermined portions of the arm members. The arm members can be, e.g., J-shaped arm members.

In the above embodiment, during sheet conveyance, the bearings 201 and 213 of the retard roller 116 are urged against the inclined surface portions of the retard roller guides 171 and 172. However, the present invention is not limited to this. More specifically, those portions of the retard roller guides 171 and 172 with which the bearings 201 and 213 come into contact need not be flat portions, but can be curved surface portions having curved sections. It suffices as far as, upon press by springs, a force having an upward component is generated at those portions of the retard roller 116 with which the bearings 201 and 213 come into contact.

Furthermore, in the above embodiment, the surfaces of the bearings 201 and 213 made of a low-friction material are urged against the inclined surface portions of the retard roller guides 171 and 172. Alternatively, components which are integral with bearings and made of a similar low-friction material may be urged against predetermined surfaces.

As has been described above, according to the present invention, the retard roller is pressed against a surface which is inclined with respect to a plane connecting the central axes of the main feed roller and retard roller, at an angle in a range of 0° (exclusive) to 90° (inclusive) from a specific direction in which a component perpendicular to a reaction force from the inclined surface is generated toward the main feed roller. When this simple mechanism is employed, sheet conveyance can be stabilized with respect to a change in torque of the torque limiter, and an economical mechanism can be realized.

As the retard roller is driven through the joint and supported by an independent suspension, the contact of the main feed roller and retard roller becomes uniform, and the operation during sheet conveyance is stabilized.

As the retard roller is driven through the joint and pressed by the spring, a mechanism from which the retard roller can be removed easily can be realized, and a worn-out retard roller can be exchanged easily.

As the portion which comes into contact with the inclined surface is made of a low-friction material, the position of the retard roller with respect to the main feed roller can be adjusted freely in accordance with a change in torque.

The rotating shaft of the retard roller is connected to the driving shaft through the joint. This, together with the support by the spring, facilitates attachment/removal of the retard roller to/from the apparatus.

The guide member has a U-shaped section. Thus, when the main roller is retreated, even if the retard roller moves away from the surface described above, the turn at the bottom of the U-shaped portion can limit a large movement of the retard roller.

What is claimed is:

1. A sheet convey apparatus comprising:

a main feed roller which rotates in a predetermined direction in contact with one surface of a paper sheet, to give to the sheet a force to convey the sheet in a sheet convey direction;

a retard roller which is arranged to oppose said main feed roller and gives to the sheet with which said retard roller is in contact a force to convey the sheet in a direction opposite to the sheet convey direction;

a torque limiter which limits a torque of said retard roller and rotates said retard roller in the sheet convey direction when the torque exceeds a predetermined limit;

a guide member which includes at least a surface inclined with respect to a plane connecting central axes of said main feed roller and retard roller at an angle in a range of 0° (exclusive) to 90° (inclusive), the inclined surface being located in the vicinity of the central axis of said retard roller;

a pair of bearings which rotatably support a rotating shaft of said retard roller; and press application means for urging a bearing of said retard roller against the inclined surface of said guide member to generate a force component toward said main feed roller which is perpendicular to a reaction force from the inclined surface.

2. An apparatus according to claim 1, wherein said pair of bearings are arranged on two sides of said rotating shaft of said retard roller, and said press application means comprises a pair of springs which apply pressing forces to said pair of bearings independently, and wherein said pressing forces by said pair of springs are independently applied to said pair of bearings at a direction of inclination from 0° to 90° to said inclined surface of said guide member.

3. An apparatus according to claim 1, wherein portions of said bearings which come into contact with the inclined surface of said guide member are made of a low friction material.

4. An apparatus according to claim 2, wherein said rotating shaft is connected to a driving shaft through a joint.

5. An apparatus according to claim 1, wherein said guide member has a U shaped notched surface, and part of the notched surface forms a linear inclined surface including an inclined surface.

6. An apparatus according to claim 1, wherein said guide member has a thin, elongated arm like shape having an inclined surface.

7. An apparatus according to claim 6, wherein said guide member comprises a J shaped member arranged inclinedly.

8. An apparatus according to claim 1, wherein the outer surface of the bearing comes into slideable contact with an inner surface of a retard roller guide.

9. An apparatus according to claim 1, wherein said pair of bearings is made of a low-friction material.

10. An apparatus according to claim 1, wherein said reaction force at the inclined surface is generated perpendicular to the inclined surface.

11. An apparatus according to claim 2, wherein said angle is formed by the inclination of the inclined surface portion and the direction of the force exerted by said press application means.

12. An apparatus according to claim 3, wherein said low-friction material is polyacetal resin.

13. An apparatus according to claim 9, wherein said low-friction material is polyacetal resin.

14. An apparatus according to claim 2, wherein said springs serve to urge the bearing in a direction perpendicular to a return guide against the inner surface of the retard roller guide.

15. A sheet convey apparatus comprising:

a main feed roller which rotates in a predetermined direction in contact with one surface of a paper sheet, to give to the sheet a force to convey the sheet in a sheet convey direction;

a retard roller which is arranged to oppose said main feed roller and gives to the sheet with which said retard roller is in contact a force to convey the sheet in a direction opposite to the sheet convey direction;

a torque limiter which limits a torque of said retard roller and rotates said retard roller in the sheet convey direction when the torque exceeds a predetermined limit;

a guide member which includes at least a surface inclined with respect to a plane connecting central axes of said main feed roller and retard roller at an angle in a range of 0° (exclusive) to 90° (inclusive), the inclined surface being located in the vicinity of the central axis of said retard roller;

a pair of bearings which rotatably support a rotating shaft of said retard roller; and press application mechanism for urging a bearing of said retard roller against the inclined surface of said guide member to generate a force component toward said main feed roller which is perpendicular to a reaction force from the inclined surface.

* * * * *